United States Patent [19]

Minami

[11] 4,103,657

[45] Aug. 1, 1978

[54] TWIN-BARREL CARBURETOR WITH AN AIR-FUEL RATIO CONTROL DEVICE

[75] Inventor: Hidehiro Minami, Yokohama, Japan

[73] Assignee: Nissan Motor Company, Limited, Yokohama, Japan

[21] Appl. No.: 695,185

[22] Filed: Jun. 11, 1976

[30] Foreign Application Priority Data

Jun. 13, 1975 [JP] Japan ..... 50-81031

[51] Int. Cl.[2] ..... F02M 7/24

[52] U.S. Cl. ..... 123/127; 123/119 EC; 123/124 R; 123/124 B; 261/23 A; 261/121 B; 261/DIG. 74; 60/285

[58] Field of Search ..... 261/121 B, DIG. 74, 261/23 A; 123/32 EE, 119 DB, 119 EC, 124 R, 127, 124 B; 60/285

[56] References Cited

U.S. PATENT DOCUMENTS

| | | | |
|---|---|---|---|
| 2,957,463 | 10/1960 | Schnabel | 261/DIG. 19 |
| 3,861,366 | 1/1975 | Masaki et al. | 261/121 B |
| 3,899,551 | 8/1975 | Korte | 261/121 B |
| 3,903,211 | 9/1975 | Kono et al. | 261/23 A |
| 3,921,612 | 11/1975 | Aono | 261/121 B |
| 3,942,493 | 3/1976 | Linder et al. | 261/121 B |
| 3,952,710 | 4/1976 | Kawayada et al. | 123/32 EE |
| 3,987,131 | 10/1976 | Hisatomi et al. | 261/121 B |
| 3,994,268 | 11/1976 | Okunishi et al. | 261/23 A |

*Primary Examiner*—Tim R. Miles

*Attorney, Agent, or Firm*—Lowe, King, Price & Markva

[57] ABSTRACT

The provision of an air-fuel ratio control is made to the secondary side of a twin-barrel carburetor as well as the primary side thereof.

4 Claims, 3 Drawing Figures

TWIN-BARREL CARBURETOR WITH AN AIR-FUEL RATIO CONTROL DEVICE

The present invention relates generally to a combination of a twin-barrel carburetor of an internal combustion engine and an air-fuel ratio control system and particularly to a combination of this type in which the air-fuel ratio control system is adapted to control to a desired air-fuel ratio the air-fuel ratio of an air-fuel mixture fed by a secondary side of the carburetor as well as the air-fuel ratio of an air-fuel mixture fed by a primary side thereof.

As is well known in the art, there are certain twin barrel carburetors which include primary and secondary intake passageways respectively having primary and secondary throttle valves rotatably mounted therein, and in which only the primary throttle valve is opened to increase the flow velocity of air drawn into the engine under normal operating conditions or ranges of the engine. This is to improve the air-fuel ratio control characteristics and to promote the atomization of fuel fed to the engine.

As a further improvement in the air-fuel ratio control characteristics, some of the previously mentioned twin-barrel carburetors are combined with an air-fuel ratio control device such that the air-fuel ratio of an air-fuel mixture provided by the carburetor is controlled to a desired air-fuel ratio by sensing the air-fuel ratio of the air-fuel mixture or the concentration of a component contained in exhaust gases of the engine; the concentration is a function of the air-fuel ratio. In accordance with the sensed air-fuel ratio or the sensed concentration of the component there is an adjustment of the flow of fuel fed for formation of the air-fuel mixture.

However, in a conventional combination of this type, the air-fuel ratio control device has been provided only for the primary side of the carburetor but has been not provided for the secondary side thereof. Control for only the primary side occurred because it was felt that the construction of the product would be overly complex to increase the cost thereof excessively by the provision of an air-fuel ratio control device for the secondary side, as well as the primary side of the carburetor.

However, it is desirable or necessary, for efficient reduction of the contents of noxious components present in engine exhaust gases and for reduction in fuel consumption, to maintain the air-fuel ratio of the air-fuel mixture burned in the engine at the desired air-fuel ratio during engine operations. The desired ratio of the mixture burned in the engine is attained, in accordance with the invention, by accurately controlling the air-fuel ratio of the air-fuel mixture provided by the secondary side of the carburetor, as well as the air-fuel ratio of the air-fuel mixture provided by the primary side thereof.

It is, therefore, an object of the invention to provide a combination of a twin-barrel carburetor for an internal combustion engine and an air-fuel ratio control system in which combination the latter is adapted to control to a desired air-fuel ratio the air-fuel ratio of an air-fuel mixture formed by a secondary side of the carburetor as well as the air-fuel ratio of an air-fuel mixture formed by a primary side thereof.

This and other objects and advantages of the invention will become more apparent from the following detailed description taken in connection with the accompanying drawings in which.

Figure 1:
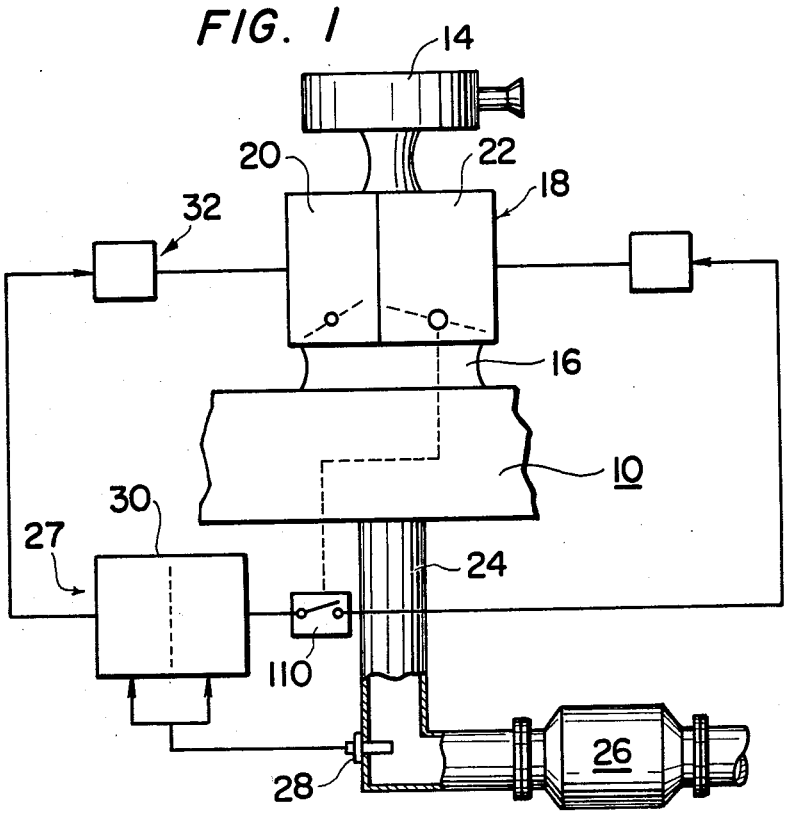
FIG. 1 is a schematic view of a first preferred embodiment of a combination according to the invention of a twin-barrel carburetor for an internal combustion engine and an air-fuel ratio control system.

Referring to FIG. 1 of the drawings, there is shown a combination according to the invention of a twin-barrel carburetor of an internal combustion engine and an air-fuel ratio control system. The engine 10 is shown to include an air cleaner 14, an intake passageway 16 communicating with the atmosphere through the air cleaner 14 and with an intake port (not shown) of the engine 10, a twin-barrel type carburetor 18 including primary and secondary sides or sections 20 and 22, an exhaust gas passageway 24 extending from an exhaust port (not shown) of the engine 10 to the atmosphere, and an exhaust gas treating device 26 such as a thermal reactor or a catalytic converter which is disposed in the exhaust gas passageway 24.

The air-fuel ratio control device 27 comprises sensing means 28 located in the exhaust gas passageway 24 upstream of the exhaust gas treating device 26 and sensing the air-fuel ratio of an air-fuel mixture burned in the engine 10 or the overall air-fuel ratio of all air and fuel which has resulted in exhaust gases of the engine 10 at the sensing point. The sensing means 28 may comprise a sensor sensing the concentration of a component such as oxygen ($O_2$), carbon monoxide (CO), carbon dioxide ($CO_2$), hydrocarbon (HC) or nitrogen oxide ($NO_x$) contained in exhaust gases of the engine 10 which concentration serves as a function of the air-fuel ratio of the air-fuel mixture or the overall air-fuel ratio. The sensing means 28 generates an electric output signal having a value representative of the sensed air-fuel ratio or the sensed concentration of the component. The output signal of the sensing means 28 is fed to a control circuit 30 electrically connected thereto. The control circuit 30 compares the value of the input signal from the sensor 28 with a reference value representative of a desired or ideal air-fuel ratio or the concentration of the component which concentration corresponds thereto. The desired air-fuel ratio is, for example, a stoichiometric air-fuel ratio when the exhaust gas treating device 26 is a catalytic converter having a ternary or triple catalyst concurrently catalytically effecting both oxidation of the noxious components such as hydrocarbons and carbon monoxide in the engine exhaust gases and reduction of the other noxious components such as nitrogen oxides therein. The control circuit 30 generates an electric control or command signal having a value representative of the error relationship between the input signal value and the reference value, such as the difference or the largeness or smallness therebetween. The control signal of the control circuit 30 is fed to fuel flow control means 32 cooperating with the carburetor 18 and adjusting in accordance with the control signal the amount of fuel fed or drawn from the carburetor 18 to the engine 10 to control or correct the air-fuel ratio of the air-fuel mixture or the overall air-fuel ratio to the desired air-fuel ratio.

Figure 2:
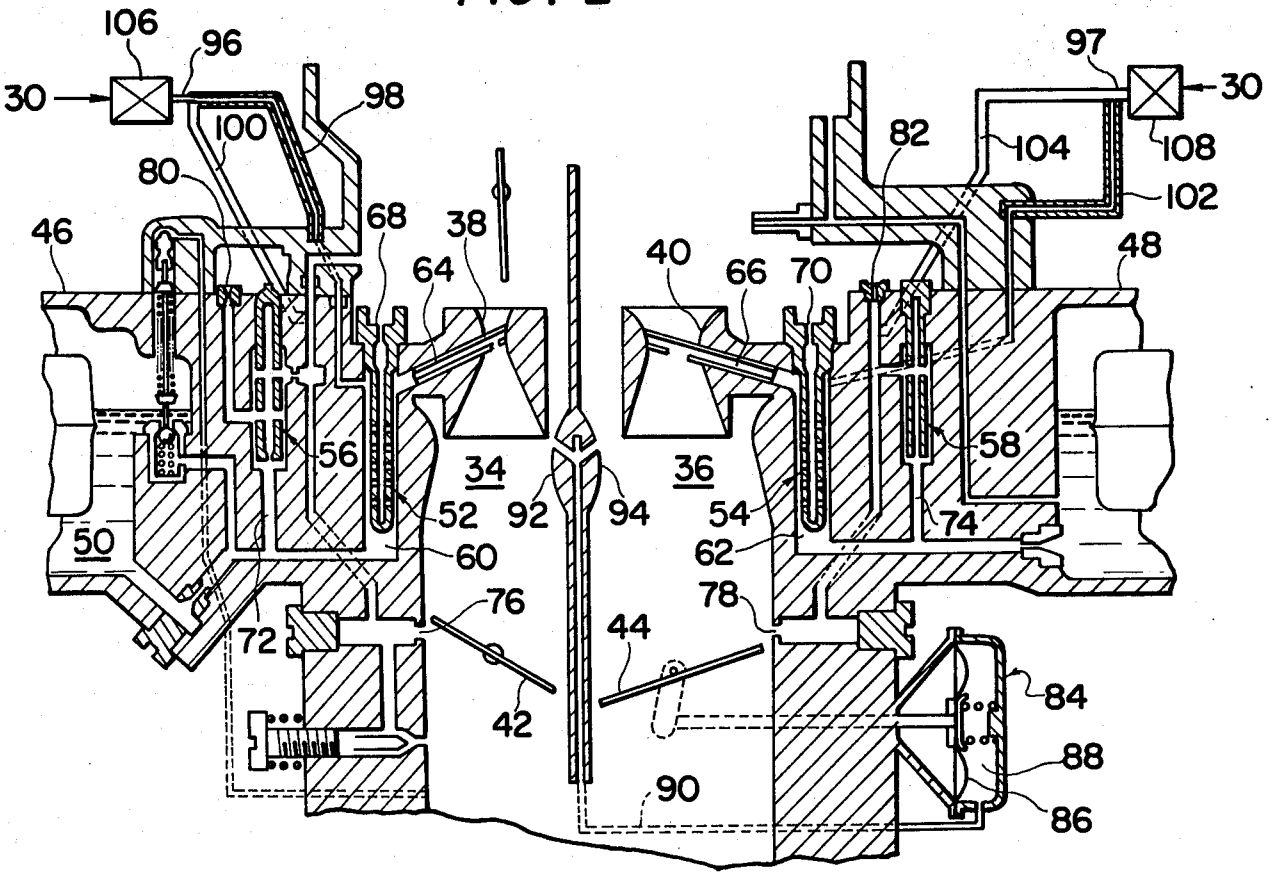
FIG. 2 is a schematic cross sectional view of an example of the carburetor forming part of the combination shown in FIG. 1.

An example of the fuel flow control means 32 is shown in FIG. 2 of the drawings together with an example of the twin-barrel carburetor 18. As shown in FIG. 2, the primary and secondary sides 20 and 22 of the carburetor 18 include intake passageways 34 and 36 forming part of the intake passageway 16 and having chokes or venturis 38 and 40 formed therein and throttle valves 42 and 44 rotatably mounted therein, fuel bowls 46 and 48 containing liquid fuel 50 therein, main systems 52 and 54, and idling and slow running systems 56 and 58, respectively. The main systems 52 and 54 include main fuel passages 60 and 62 communicating with the fuel bowls 46 and 48, main nozzles 64 and 66 communicating with the main fuel passages 60 and 62 and opening into the chokes 38 and 40, and main air bleed passages 68 and 70 communicating with the atmosphere and with the main fuel passages 60 and 62 and through which air is drawn thereinto to emulsify fuel drawn from the main nozzles 64 and 66 into the primary and secondary intake passageways 34 and 36, respectively. The idling and slow running systems 56 and 58 include idling and slow running fuel passages 72 and 74 branching off from the main fuel passages 60 and 62 and having slow running ports 76 and 78 opening into the intake passageways 34 and 36, and idling and slow running air bleed passages 80 and 82 communicating with the atmosphere and with the idling and slow running fuel passages 72 and 74 and through which air is drawn thereinto to emulsify fuel drawn therefrom into the intake passageways 34 and 36, respectively. The secondary section 22 also includes a vacuum actuator 84 having a flexible diaphragm 86 which is operatively connected to the secondary throttle valve 44 and is formed on one side thereof with a vacuum chamber 88. The vacuum chamber 88 communicates with the intake passageways 34 and 36 through passage means 90 which opens into venturis 92 and 94 formed in the intake passages 34 and 36. The secondary throttle valve 44 is normally closed and starts to be opened by the vacuum in the venturi 92 when the primary throttle valve 42 is substantially fully opened.

The fuel flow control means 32 comprises first and second common auxiliary air bleed passages 96 and 97 communicating with the atmosphere, first and second auxiliary air bleed passages 98 and 100 branching off from the first common auxiliary air bleed passage 96 and communicating respectively with the primary main and idling and slow running fuel passages 60 and 72 and through which additional air is drawn thereinto from the common auxiliary air bleed passage 96 to emulsify the fuel drawn into the primary intake passageway 34, third and fourth auxiliary air bleed passages 102 and 104 branching off from the second common auxiliary air bleed passage 97 and communicating respectively with the secondary main and idling and slow running fuel passages 62 and 74 and through which additional air is drawn thereinto from the common auxiliary air bleed passage 97 to emulsify the fuel drawn to the secondary intake passageway 36, and first and second control valve means 106 and 108 associated respectively with the first and second common auxiliary air bleed passages 96 and 97 to open and close same and electrically connected to the control circuit 30 to receive the control signal therefrom. A switch circuit 110 (FIG. 1) may be interposed between the control circuit 30 and the second control valve means 108 and controls connection therebetween in accordance with the degree of opening of the secondary throttle valve 44.

The combination of the carburetor 18 and the air-fuel ratio control device 27 thus far described is operated as follows:

When the engine 10 is running under normal conditions, the primary throttle valve 42 only is opened so that the engine 10 is fed with an air-fuel mixture from the primary side 20 only of the carburetor 18 through the primary intake passageway 16. When the exhaust gases of the air-fuel mixture reach the sensing means 28, the sensing means 28 senses the air-fuel ratio of the air-fuel mixture or the concentration of a component present in the engine exhaust gases. Assuming that the sensing means 28 is an oxygen sensor, the sensor 28 generates an output signal having a value representative of the sensed concentration of oxygen. When the concentration signal value is larger than the reference value, that is, the sensed air-fuel ratio of the air-fuel mixture is higher than the desired air-fuel ratio, the control circuit 30 generates a control signal which causes the fuel flow control means 32 to increase the amount of fuel drawn from the primary main and idling and slow running systems 52 and 56 into the primary intake passageway 34. In this condition the first control valve means 106 closes the first common auxiliary air bleed passage 96 in response to the control signal to inhibit air from being drawn therefrom into the primary main and idling and slow running systems 52 and 56 through the branch auxiliary air bleed passages 98 and 100 to thereby increase the flow of fuel drawn from the primary main and idling and slow running systems 52 and 56 into the primary intake passageway 34 to correct the engine or overall air-fuel ratio to the desired air-fuel ratio. On the contrary, when the concentration signal value is smaller than the reference value, that is, the sensed air-fuel ratio is lower than the desired air-fuel ratio, the control circuit 30 generates a control signal which causes the fuel flow control means 32 to reduce the amount of fuel drawn from the primary main and idling and slow running systems 52 and 56 into the primary intake passageway 34. In this condition the first control valve means 106 opens the first auxiliary air bleed passage 96 in response to the control signal to allow air to be drawn therefrom into the primary main and idling and slow running fuel passages 60 and 72 through the branch auxiliary air bleed passages 98 and 100 in addition to air drawn thereinto from the primary main and idling and slow running air bleed passages 68 and 80 to thereby reduce the flow of fuel drawn from the main and idling and slow running fuel passages 60 and 72 into the primary intake passageway 34 to correct the engine or overall air-fuel ratio to the desired air-fuel ratio. At this time, since the secondary throttle valve 44 is substantially fully closed, the switch circuit 110 is opened so that the second control valve means 108 is disconnected from the control circuit 30 and is in its dormant condition.

When the secondary throttle valve 44 begins to be opened, the switch circuit 110 is closed so that the second control valve means 108 is connected to the control circuit 30 and is rendered operative. As a result, simultaneously with the air-fuel ratio of the air-fuel mixture fed by the primary side 20 of the carburetor 18 being controlled to the desired air-fuel ratio as described hereinbefore, the air-fuel ratio of the air-fuel mixture fed by the secondary side 22 of the carburetor 18 is controlled to the desired air-fuel ratio as follows; When the concentration signal value is larger than the reference value, the control signal of the control circuit 30 causes the second control valve means 108 to close the second common auxiliary air bleed passage 97 to inhibit air to be drawn therefrom into the secondary main and idling and slow running systems 54 and 58 through the branch auxiliary air bleed passages 102 and 104 to thereby increase the flow of fuel drawn from the secondary main and idling and slow running systems 54 and 58 into the secondary intake passageway 36 to correct the air-fuel ratio to the desired air-fuel ratio. On the contrary, when the concentration signal value is smaller than the reference value, the control signal from the control circuit 30 causes the second control valve means 108 to open the second common auxiliary air bleed passage 97 to allow air to be drawn therefrom into the secondary main and idling and slow running fuel passages 62 and 74 through the branch auxiliary air bleed passages 102 and 104 in addition to air drawn thereinto from the secondary main and idling and slow running air bleed passages 70 and 82 to thereby reduce the flow of fuel drawn from the secondary main and idling and slow running fuel passages 62 and 74 into the secondary intake passageway 36 to correct the air-fuel ratio to the desired air-fuel ratio.

Each of the branch auxiliary air bleed passages 98, 100, 102 and 104 may be provided therein with an orifice (not shown) which prevents the flow of air in each pair of branch auxiliary air bleed passages from interfering with each other and to cause air to satisfactorily flow in each of the branch auxiliary air bleed passages 98, 100, 102 and 104.

Figure 3:
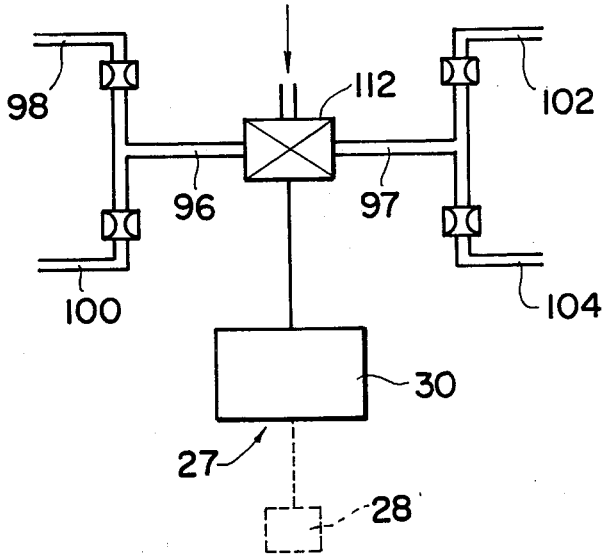
FIG. 3 is a schematic view of a portion of a second preferred embodiment of a combination according to the invention of a twin-barrel carburetor for an internal combustion engine and an air-fuel ratio control system.

Referring to FIG. 3 of the drawings, there is shown only a part of a second preferred embodiment of a combination according to the invention of a twin-barrel carburetor and an air-fuel ratio control device. The embodiment shown in FIG. 3 is different from the embodiment shown in FIG. 1 in that a single control valve means 112 is provided to be associated with first and second common auxiliary air bleed passages 96 and 97, in lieu of the first and second control valve means 106 and 108 in the embodiment of FIG. 1 and accordingly a switch circuit 110 is not provided. The control valve means 112 functions similarly to the first control valve means 106 when the primary throttle valve 42 is opened and the secondary throttle valve 44 is substantially fully closed so that no air-fuel mixture is fed from the secondary side 22 of the carburetor 18, and functions to concurrently close and open both the first and second common auxiliary air bleed passages 96 and 97 to inhibit and allow additional air to be drawn from same into both the primary and secondary main and idling and slow running fuel passages 60, 72 and 62, 74 to thereby increase and reduce the flow of fuel drawn therefrom into both the primary and secondary intake passageways 34 and 36 in response to the control signals of the control circuit 30 which signals are representative of the sensed air-fuel ratio being higher and lower than the desired air-fuel ratio, respectively when the primary and secondary throttle valves 42 and 44 are both opened.

The fuel flow control means 32 may comprise, for example, a primary auxiliary fuel passage (not shown) bypassing an orifice (not shown) in the primary main fuel passage 60 upstream of the junction between the same and the primary idling and slow running fuel passage 72, a secondary auxiliary fuel passage (not shown) bypassing an orifice (not shown) in the secondary main fuel passage 62 upstream of the junction between the same and the secondary idling and slow running fuel passage 74, and first and second control valve means (not shown) associated respectively with the primary and secondary auxiliary fuel passages to directly reduce and increase the flow of the fuel drawn from the primary and secondary main fuel passages 60 and 62 into the primary and secondary intake passages 34 and 36, in lieu of the auxiliary air bleed passages 96, 98, 100; and 97, 102, 104 and the control valve means 106 and 108 or 112.

The control valve means 106, 108 and 112 each include, as means for operating each control valve means in response to the command signal a solenoid, a diaphragm assembly or a servo motor that may be continuously or linearly operated between a fully closed position and a fully open position, in lieu of being on-off operated.

It will be appreciated that the invention provides a combination of a twin-barrel carburetor and an air-fuel ratio control device in which combination the latter is adapted to control to a desired air-fuel ratio the air-fuel ratio of the air-fuel mixture formed by the secondary side of the carburetor as well as the air-fuel ratio of the air-fuel mixture formed by the primary side of the carburetor so that the air-fuel ratio of the air-fuel mixture burned in the engine is accurately controlled to the desired air-fuel ratio during all engine operations to increase the performance of the engine and to reduce the contents of noxious components contained in the engine exhaust gases.

It will be also appreciated that the invention provides a combination of this type in which the air-fuel ratio control device controls both the primary and secondary sides of the carburetor with a single control circuit and two or a single control valve means.

What is claimed is:

1. In combination with an internal combustion engine, a carburetor, and an exhaust gas passageway, the carburetor including:

a primary intake passageway having:

a primary throttle valve rotatably mounted therein, a primary main fuel passage communicating with the primary intake passageway and from which fuel is drawn into the primary intake passageway, a primary low speed running fuel passage communicating with the primary intake passageway and from which fuel is drawn into the primary intake passageway;

a secondary intake passageway having:

a secondary throttle valve rotatably mounted therein, a secondary main fuel passage communicating with the secondary intake passageway and from which fuel is drawn into the secondary intake passageway, a secondary low speed running fuel passage communicating with the secondary intake passageway and from which fuel is drawn into the secondary intake passageway;

an improved air-fuel ratio control system comprising:

a sensor located in the exhaust gas passageway for sensing the concentration of a component contained in exhaust gases of the engine and for generating an electric signal representative of the sensed concentration of the component, said concentration being a function of the air-fuel ratio of an air-fuel mixture formed by the carburetor, a control circuit electrically connected to said sensor to be responsive to said signal for comparing the value of said signal with a reference value representative of a desired air-fuel ratio and for generating a command signal representative of an error between said signal value and said reference value, a first air bleed passage communicating with the atmosphere and with the primary main and low speed running fuel passage, first control valve means located relative to said first air bleed passage for controlling the flow of air drawn into the primary main and low speed running fuel passages through said first air bleed passage, said first control valve means being electrically connected to said control circuit and being operable, in response to said command signal, for reducing and increasing the flow of said air, thereby respectively to increase and reduce the flow of fuel drawn from the primary main and low speed running fuel passages into the primary intake passageway and to control the air-fuel ratio of an air-fuel mixture formed by the carburetor to said desired air-fuel ratio, a second air bleed passage communicating with the atmosphere and with the secondary main and low speed running fuel passages, second control valve means located relative to said second air bleed passage for controlling the flow of air drawn into the secondary main and low speed running fuel passages through said second air bleed passage, said second control valve means being electrically connected to said control circuit and being operable, in response to said command signal, for reducing and increasing the flow of said air, thereby respectively to increase and reduce the flow of fuel drawn from the secondary main and low speed running fuel passages into the secondary intake passageway and to control the air-fuel ratio of an air-fuel mixture formed by the carburetor to said desired air-fuel ratio, and a switch means interposed between said control circuit and said second control valve means for connecting and disconnecting said second control valve means to and from said control circuit in response to said secondary throttle valve being opened and closed, respectively.

2. In combination with an internal combustion engine, a carburetor, and an exhaust gas passageway;

the carburetor including:

a primary intake passageway having a primary throttle valve rotatably mounted therein, primary fuel supply passage means communicating with the primary intake passageway and from which fuel is drawn into the primary intake passageway to form a primary air-fuel mixture, a secondary intake passageway having a secondary throttle valve rotatably mounted therein, secondary fuel supply passage means communicating with the secondary intake passageway and from which fuel is drawn into the secondary intake passageway to form a secondary air-fuel mixture;

an improved air-fuel ratio control system comprising:

sensing means located in the exhaust gas passageway for sensing the concentration of a component contained in exhaust gases of the engine for generating an electric signal representative of the sensed concentration of the component, said concentration being a function of the air-fuel ratio of an air-fuel mixture formed by the carburetor, a control circuit electrically connected to said sensing means to be responsive to said signal for comparing the value of said signal with a reference value representative of a desired air-fuel ratio and for generating a command signal representative of an error between said signal value and said reference value, first fuel flow control means electrically connected to said control circuit to be responsive to said command signal and associated with said primary fuel supply passage means for adjusting, in accordance with said command signal, the flow of fuel drawn from the primary fuel supply passage means into the primary intake passageway, whereby the air-fuel ratio of the primary air-fuel mixture is controlled to said desired air-fuel ratio, second fuel flow control means electrically connected to said control circuit to be responsive to said command signal and associated with said secondary fuel supply passage means for adjusting, in accordance with said command signal, the flow of fuel drawn from the secondary fuel supply passage means into the secondary intake passageway, whereby the air-fuel ratio of the secondary air-fuel mixture is controlled to said desired air-fuel ratio, and switch means interposed between said control circuit and said second control valve means for connecting and disconnecting said second control valve means to and from said control circuit in response to said secondary throttle valve being opened and closed, respectively.

3. In combination with an internal combustion engine, a carburetor, and an exhaust gas passageway;

the carburetor including:

a primary intake passageway having:

a primary throttle valve rotatably mounted therein, a primary main fuel passage communicating with the primary intake passageway and from which fuel is drawn into the primary intake passageway, a primary main air bleed passage communicating with the atmosphere and with the primary main fuel passage, a primary low speed running fuel passage communicating with the primary intake passageway and from which fuel is drawn into the primary intake passageway, a primary low speed running air bleed passage communicating with the atmosphere and with the primary low speed running fuel passage;

a secondary intake passageway having: p1 a secondary throttle valve rotatably mounted therein, a secondary main fuel passage communicating with the secondary intake passageway and from which fuel is drawn into the secondary intake passageway, a secondary main air bleed passage communicating with the atmosphere and with the secondary main fuel passage, a secondary low speed running fuel passage communicating with the secondary intake passageway and from which fuel is drawn into the secondary intake passageway, a secondary low speed running air bleed passage communicating with the atmosphere, and with the secondary low speed running fuel passage;

an improved air-fuel ratio control system comprising:

a sensor located in the exhaust gas passageway for sensing the concentration of a component contained in exhaust gases of the engine and for generating an electric signal representative of the sensed concentration of the component, said concentration being a function of the air-fuel ratio of an air-fuel mixture formed by the carburetor, a control circuit electrically connected to said sensor to be responsive to said signal for comparing the value of said signal with a reference value representative of a desired air-fuel ratio and for generating a command signal representative of an error between said signal value and said reference value, a first common air bleed passage communicating with the atmosphere first and second auxiliary air bleed passages branching off from said first common air bleed passage and communicating respectively with the primary main and low speed running fuel passages, first control valve means located relative to said first common air bleed passage for controlling the flow of air drawn into the primary main and low speed running fuel passages through said first common air bleed passage, said first control valve means being electrically connected to said control circuit to be responsive to said command signal and being operable, in response to said command signal, for reducing and increasing the flow of said air, thereby to increase and reduce the flow of fuel drawn from the primary main and low speed running fuel passages into the primary intake passageway and to control the air-fuel ratio of an air-fuel mixture formed by the carburetor to said desired air-fuel ratio, a second common air bleed passage communicating with the atmosphere, third and fourth auxiliary air bleed passages branching off from said second common air bleed passage and communicating respectively with the secondary main and low speed running fuel passages, second control valve means located relative to said second common air bleed passage for controlling the flow of air drawn into the secondary main and low speed running fuel passages through said second common air bleed passage, said second control valve means being electrically connected to said control circuit to be responsive to said command signal and being operable, in response to said command signal, for reducing and increasing the flow of said air, thereby to increase and reduce the flow of fuel drawn from the secondary main and low speed running fuel passages into the secondary intake passageway and to control the air-fuel ratio of an air-fuel mixture formed by the carburetor to said desired air-fuel ratio, and switch means interposed between said control circuit and said second control valve means for connecting and disconnecting said second control valve means to and from said control circuit in response to said secondary throttle valve being opened and closed, respectively.

4. In combination with an internal combustion, engine, a carburetor, and an exhaust gas passageway;

the carburetor including:

a primary intake passageway having a primary throttle valve rotatably mounted therein, primary fuel supply passage means communicating with the primary intake passageway and from which fuel is drawn into the primary intake passageway to form a primary air-fuel mixture, a secondary intake passageway having a secondary throttle valve rotatably mounted therein, secondary fuel supply passage means communicating with the secondary intake passageway and from which fuel is drawn into the secondary intake passageway to form a secondary air-fuel mixture;

an improved air-fuel ratio control system comprising:

sensing means located in the exhaust gas passageway for sensing the concentration of a component contained in exhaust gases of the engine for generating an electric signal representative of the sensed concentration of the component, said concentration being a function of the air-fuel ratio of an air-fuel mixture formed by the carburetor, first and second control circuits, each of which is electrically connected to said sensing means for receiving said signal and for comparing the value of said signal with a reference value representative of a desired air-fuel ratio and for respectively generating a command signal representative of an error between said signal value and said reference value, first fuel flow control means electrically connected to said first control circuit to be responsive to said command signal and associated with said primary fuel supply passage means for adjusting, in accordance with said command signal, the flow of fuel drawn from the primary fuel supply passage means into the primary intake passageway, whereby the air-fuel ratio of the primary air-fuel mixture is controlled to said desired air-fuel ratio, second fuel flow control means electrically connected to said second control circuit to be responsive to said command signal and associated with said secondary fuel supply passage means for adjusting, in accordance with said command signal, the flow of fuel drawn from the secondary fuel supply passage means into the secondary intake passageway, whereby the air-fuel ratio of the secondary air-fuel mixture is controlled to said desired air-fuel ratio, and switch means interposed between said second control circuit and said second control valve means for connecting and disconnecting said second control valve means to and from said second control circuit in response to said secondary throttle valve being opened and closed, respectively.

* * * * *